United States Patent [19]

Kanter

[11] 4,355,634

[45] Oct. 26, 1982

[54] LOCATOR DEVICE FOR EXTERNAL CARDIAC COMPRESSION DURING CARDIOPULMONARY RESUSCITATION

[75] Inventor: Spencer I. Kanter, 123 Charter Rd., Wethersfield, Conn. 06109

[73] Assignee: Spencer I. Kanter, Wethersfield, Conn.

[21] Appl. No.: 221,538

[22] Filed: Dec. 31, 1980

[51] Int. Cl.[3] ..... A61H 31/00

[52] U.S. Cl. ..... 128/28

[58] Field of Search ..... 128/28, 60, 55, 44, 128/54; 273/67 B, 18

[56] References Cited

U.S. PATENT DOCUMENTS

| | | | |
|---|---|---|---|
| 601,779 | 4/1898 | Roberts | 273/18 |
| 793,527 | 6/1905 | King | 128/60 |
| 1,535,822 | 4/1925 | Goodwin | 128/60 |
| 2,450,935 | 10/1948 | Carr | 128/54 |
| 3,228,392 | 1/1966 | Speyer | 128/55 |
| 3,401,686 | 9/1968 | Edwards | 128/28 |
| 4,059,099 | 11/1977 | Davis | 128/28 |
| 4,164,216 | 8/1979 | Person | 128/28 |
| 4,182,317 | 1/1980 | Ash | 128/28 |

FOREIGN PATENT DOCUMENTS

| | | | |
|---|---|---|---|
| 4140017 | 7/1934 | United Kingdom | 273/67 B |

*Primary Examiner*—Richard C. Pinkham
*Assistant Examiner*—T. Brown
*Attorney, Agent, or Firm*—Prutzman, Kalb, Chilton & Alix

[57] ABSTRACT

A disposable external cardiac compression device is provided for use in a CPR technique. The device has a height equal to the minimum depth recommended for cardiac compression and comprises a rectangular elongated main body portion of unyielding foam plastic and top and bottom cushion-like foam layers secured thereof. The bottom layer extends longitudinally beyond the main body portion to form flexible locator flanges having a length equal to the width of two fingers for properly locating the device on the sternum of a patient. The top surface has a length and width sufficient to conformably accommodate engagement by the heel of a rescuer's hand placed thereon. The locator flanges have sufficient flexibility to permit ready yielding upon application of pressure against the top surface of the main body portion and the continuous bottom surface has an adhesive for removably adhering the device to the patient. The device may include a palpable pressure signaling and/or timing member and a removable protective strip that covers the adhesive prior to use.

7 Claims, 5 Drawing Figures

LOCATOR DEVICE FOR EXTERNAL CARDIAC COMPRESSION DURING CARDIOPULMONARY RESUSCITATION

The present invention relates generally to cardiopulmonary resuscitation (CPR) and is more specifically concerned with a new and improved device for the effective performance of the external cardiac compression phase of CPR.

When cardiac arrest occurs there is a cessation of blood circulation or, at a minimum, a lack of sufficient circulation to sustain life. When this condition occurs it is necessary to apply both artificial circulation and artificial ventilation. Both phases are necessary for the correct performance of the CPR technique. The present invention is concerned primarily with the artificial circulation or external cardiac compression phase. This portion of the CPR procedure is applied to the middle of the chest at the lower half of the sternum or breast bone and its proper, safe and effective performance requires more than simply pushing on the chest of the patient. One of the primary requirements is that the hands of the person applying the external cardiac compression be placed in the proper location since deviation from the proper procedure and location can result in damage to the ribs and underlying organs of the patient. Injury to the chest cage is the most common complication and can occur when the hands are improperly placed on the sternum. If the hands are too high, fracture of the upper sternum and/or clavicle can result. When the hands are placed too low on the sternum, the xiphoid process located at the lower tip of the sternum can be driven into the liver, producing severe lacerations. When the hands are placed too far off center to one side or the other or when they slip from their proper central position over the lower portion of the sternum, compression may cause fracture of the ribs and/or lacerations to the lung and/or heart. Another primary requirement for effective closed chest heart hassage is that the sternum be depressed 1½" to 2" for all adults. The pressure to accomplish this will vary with the size of the adult, buth the depth of compression remains relatively constant. Most rescuers cannot accurately estimate how much depression is equal to 1½" to 2". Underestimating this minimum height of compression may result in less circulation of blood then is necessary to sustain life. Overestimating the minimum height of compression may result in injury to the patient which would preclude their survival even with effective circulation.

In order to avoid injury to the chest or thoracic cage and underlying organs, the present invention provides a device for accurately locating the correct pressure point on the patient's lower sternum and maintaining that accurate positioning until the patient has returned to spontaneous respiration and the natural heart action is normalized. The locator also provides a visual and palpable guide for the depth to which the chest must be compressed. The CPR locator provides a device which by its height indicates the minimum depth of compression necessary to maintain effective circulation in a victim of cardiac arrest. The device is of simple, light weight construction that can be rapidly applied to the patient when needed and is disposable after use. The device permits not only accurate placement of the heel of the hand of the person performing the CPR but also maintains the accurately located position as the patient is moved or if the CPR is being performed by a single rescuer who also must administer artificial ventilation. The device provides for rapid and accurate tactile and visual location of the appropriate pressure point and provides for a definite and unchanging pressure point once it is located. Additionally, since the device elevates the hands of the person away from the rigs of the patient for the depth of compression, a more normal hand position is facilitated and in fact, the device even permits the use of a portion of the hand other than the heel if the location or condition of the patient prevents use thereof. Finally, the device of the present invention can help to maintain the correct applied chest pressure and a proper release and timing by the incorporation of a palpable pressure responsive signal unit within the device to assure accurate and proper application of the CPR procedure.

These and other advantages are achieved in accordance with the present invention by providing a new and improved external cardiac compression device comprised of an elongated main body portion and a locator flange portion connected to and extending longitudinally from at least one end of the body portion. The bottom surface of the flange is continuous with the bottom surface of the body portion while the top surface of the body portion is in spaced overlying relationship to its bottom surface along its longitudinal extent and has a length, width and texture sufficient to comformably accommodate engagement by the heel of a rescuer's hand placed thereon. The locator flange has sufficient flexibility to permit ready yielding upon application of pressure against the top surface and the continuous bottom surface has adhesive means thereon for removably adhering the device to the patient along the patient's lower sternum for the entire length and width of the device.

The details of the invention will be described further in connection with the accompanying drawing in which.

Figure 1:
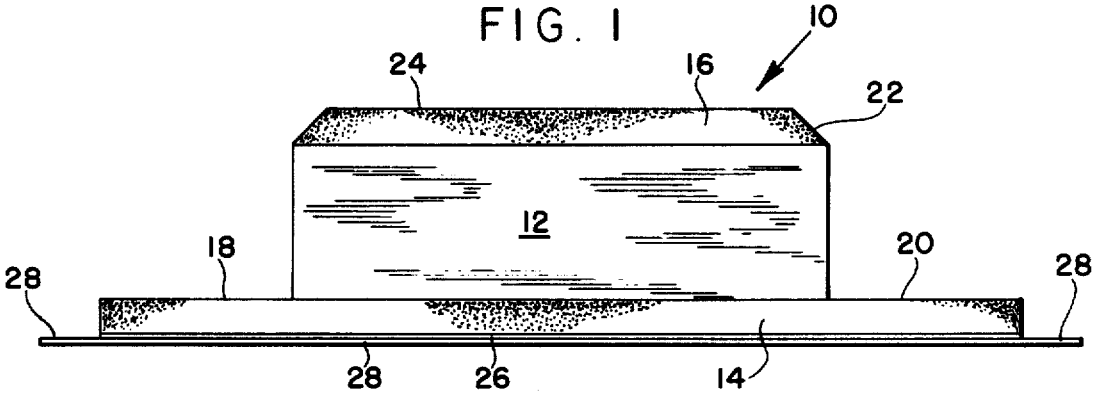
FIG. 1 is a side elevational view of a first embodiment of the device of the present invention.
Figure 2:
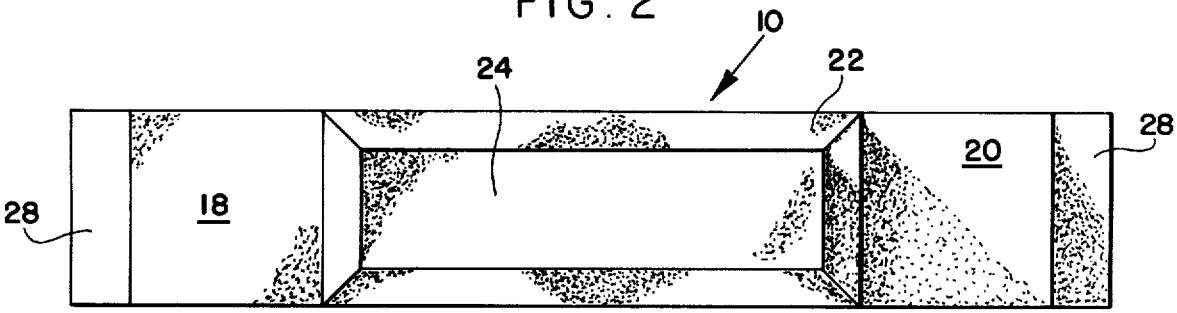
FIG. 2 is a top plan view of the device of FIG. 1.
Figure 3:
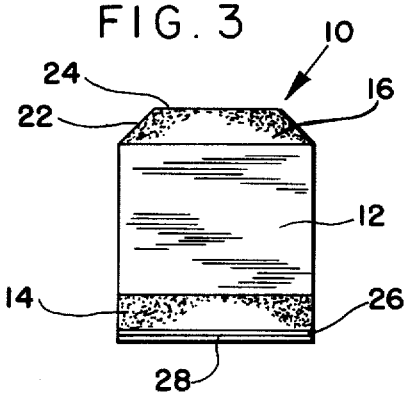
FIG. 3 is an end elevational view of the device of FIG. 1.

Referring now to the drawings in greater detail, the invention is shown as embodied within an external cardiac compression device 10 consisting essentially of a unitary three piece assembly having an elongated, generally rectangular main body portion 12 constructed of relatively unyielding material and a pair of softer foam-like longitudinally extending bottom and top layers 14 and 16 respectively, permanently secured to the main body portion. The bottom layer 14 extends not only along the full longitudinal extent of the main body 12 but projects beyond the opposite longitudinal ends of the main body portion to form locator flanges 18, 20. As best seen in FIGS. 2 and 3, the locator flanges have a width substantially equal to the width of the main body portion 12 and a length of about the same dimension as their width. The main body portion 12 is of rectangular longitudinal cross-section with its width being of a suitable size so that upon placement of the device on the longitudinal axis of a patient's sternum, it will rest comfortably and conformably over the sternum and not substantially overlap the longitudinal edges thereof so as to detrimentally engage the ribs. In the specific embodiment illustrated and designed as the adult size, the width of the cardiac compression device is approximately one and one quarter inches and the length of the main body portion is about three and one half to four inches. The height of the central body portion 12 should be sufficient when combined with the bottom layer 14 and top layer 16 to accommodate the typical compressive movement of the chest during the CPR procedure. In this connection adequate artificial circulation is achieved when the chest is compressed in an adult by a distance of about one and one half inches or as much as two inches. This depth of compression is effective to squeeze the heart between the sternum and the spine, forcing the blood into the vessels that carry it to the lungs where it can be oxyginated by artificial ventilation for circulation throughout the body.

Since the device of the present invention is intended to be used in the normal CPR technique, the length and width of the main body portion should be adequate to comfortably and conformably accommodate the heel of the rescuer's hand. As can be seen, the top layer 16 conforms to and fully covers the main body portion 12 but is provided with a peripheral chamfer 22 that defines the flat top surface 24 of layer 16. This facilitates centering of the rescuer's hand on the device while the combined height of the assembly assures that it is elevated above the chest of the patient for effecting the desired external cardiac compression. This is significant since it spaces the hand from the rib cage even when the required depth of compression is reached and places it in a more normal hand position while avoiding application of pressure on the ribs.

As mentioned, the layers 14, 16 are formed of relatively soft resilient foam-like or cushion-like material while the main body portion 12 is made from a relatively harder, more solid material that is essentially unyielding during use. The cushion-like outer layers enable the device to conform the body structure variations of both the patient and the rescuer while at the same time substantially maintaining the necessary height for proper compression. Thus, the thickness of each layer is preferably about one quarter inch.

Since the entire device is disposable, the material used for each component should be of low cost. Consequently, in the preferred embodiment, the main body portion 12 is made of rigid or semi-rigid material of light weight and low cost. In this connection, a high strength dimensionally stable foam material such as a high compressive strength expanded polyethylene material, e.g. Ethafoam 900 sold by Dow Chemical, and having a strength of 48 psi at 10% strain using ASTM D3575 test B. Other materials such as polystyrene or injection molded polypropylene may be used. The layers 14, 16 on the other hand, are formed of resilient cushion-like foam material exhibiting a substantially compressibility and resilience. Although a wide variety of materials may be used, excellent results have been obtained with cross-linked polyethylene foam having a compressive load deflection of 60 at 25% and sold under the designation Minicel L-200 by Dow Chemical Company.

The flat bottom surface of bottom layer 14 is provided with a continuous layer 26 of adhesive or the like for removably securing the device in the proper location above the patient's sternum. As will be appreciated, the layer of adhesive can be applied directly to the bottom layer 14 along its full length. A protective release or peel-off strip 28 can also be used to cover the adhesive layer 26 in order to provide a protective covering for the adhesive prior to use. The peel-off strip 28 would extend beyond the end flanges 18, 20 on at least one end, or at both ends as shown to provide a pull-tab facilitating removal of the strip.

Since the device of the present invention is used in the standard CPR technique with as little variation from that technique as possible, it is important to fully understand the procedure for the CPR technique as well as the manner of utilizing the device therein. In accordance with the standard procedure it is necessary to locate the proper pressure point on the patient's sternum. The sternum is the flat bony structure that joins the ribs in front of the chest and is also referred to as the breast bone. The upper part of the sternum is joined to the clavicle or collar bones while the lower end terminates in an inwardly curved bony protuberance or xiphoid process located in substantial overlying relationship to the patient's liver. The ribs, or course, provide a protective cage known as the thoracic cage that provides protection for the lungs which lie directly below them and to some extent for the liver as well as the heart.

In order to locate the proper pressure point it is necessary for the rescuer to first locate the xiphoid process and measure two finger widths from it along the sternum before placing the heel of one hand over the lower half of the sternum. The device of the present invention eliminates the need for this measurement since the locator flanges 18, 20 designably exhibit a length substantially equal to the width of two fingers. As mentioned hereinbefore, placement of the hand at an improper location when attempting to compress the sternum can result in fracture of the ribs, laceration of the lungs or heart, fracture of the collar bone, or lacerations of the liver. Since the xiphoid process is the most readily recognizable and easily detected reference point, the device of the present invention eliminates all other measurements by simply placing one flanged end of the device even with the bottom of the xiphoid process with the balance of the device extending longitudinally along the sternum toward the head of the patient. In this manner, a fascile and palpable reference point can be readily located and the device can be rapidly and correctly adhered to the patient without the need for any additional measurement and with the assurance that an accurate and unchanging pressure point has been located.

It is a feature of the present invention that the locator flanges 18, 20 at the longitudinal ends of the main body portion 12 exhibit a substantial flexibility so as not to transmit pressure to the xiphoid process while adhering to the chest above it. This is achieved in accordance with the present invention by providing locating flanges of minimal thickness and highly flexible material thereby assuring appropriate flexibility together with its adhering accurate locator function.

As can be appreciated from the foregoing description, the device of the present invention provides not only accurate placement of the device on the patient but also a firm and accurate support for the heel of the rescuer's hand. Through the use of an adhesive layer 26 of sufficient area shaped to the chest it maintains that accurate placement or positioning as the patient is moved or, where there is but one rescuer, as the rescuer moves between the functions of external cardiac compression and artificial ventilation. This permits the rescuer to quickly return to the external cardiac compression without the necessity for again locating the correct pressure point. Since it is also essential that no pressure be placed on the ribs, the elevated top surface 24 of the device, as mentioned hereinbefore, advantageously spaces the heel of the rescuer's hand from the sternum and from the ribs so that a more normal hand position can be sued when applying the external cardiac compression. In fact, with the device of the present invention, it is even possible to use the palm of the hand with the palm positioned at ninety degrees to the sternum when the rescuer must straddle the patient due to confined quarters.

Figure 4:
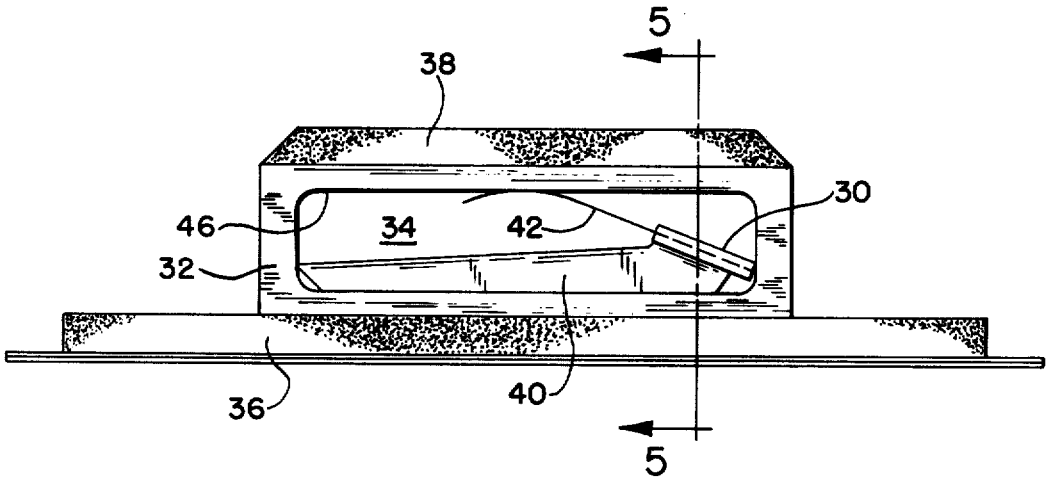
FIG. 4 is a side elevational view, similar to FIG. 1, showing a second embodiment of the device of the present invention; and, FIG. 5 is a cross-sectional view of the device of FIG. 4 taken along the line 5—5 of FIG. 4.
Figure 5:
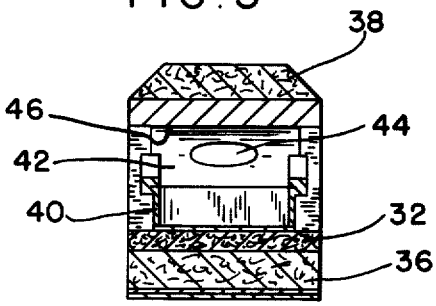

It is another advantage of the device of the present invention that it can incorporate a perceptible, palpable signal so that the rescuer can feel when correct chest pressure has been achieved and to assist in the timing of the compression operation which, ideally, should fall within the range of about sixty to eighty compressions per minute. This is achieved as shown in the embodiment of FIGS. 4 and 5 by incorporating into the device an appropriate palpable signaling member 30. In the specific embodiment illustrated, the main body portion 32 of the device is provided with a transversely extending generally rectangular aperture 34 centrally spaced between the bottom and top cushioning layers 36, 38 respectively. Within the aperture 34 is mounted an example of a palpable tactile signaling device 30 in the form of a "snapper" consisting of a base or shell member 40 having affixed thereto a flexible leaf spring 42 engages the top surface 46 of the aperture so that it can be driven downwardly during the compression strokes applied to the top layer 38 of the device. In this connection it is known that in order to provide effective artificial circulation it is necessary to apply to the adult patient a compression force in the range of about 80–90 pounds. As will be appreciated, the pressure requirement is less with adolescents and young children and comparable sizes of this device can be used for those individuals. In the specific embodiment shown in FIG. 4, the flexibility of the main body portion 32, in combination with the leaf spring will provide an appropriate palpable tactile signal at a pressure of about 85 pounds and will not snap back to its original position until the pressure has been reduced to a level which will not present an obstacle to the return flow of blood to the heart. This provides not only a signal indicating that the correct chest pressure is being applied but also a second, pressure-release signal which assists in the timing of the compression strokes. It should also be noted that when using the structure shown in FIGS. 4 and 5, it is generally preferred to use a material for the main body portion 32 that is firm so that the pressure is fully transmitted to the bottom surface 38 of the main body portion 32 with only enough deflection to "snap" the spring 42 at the predetermined pressure. The layers 36, 38 are substantially the same as layers 14, 16 but may be reduced in thickness, if desired, to a thickness of about one eighth inch. As can be appreciated, this embodiment facilitates ready replacement of the signaling device to provide pressure adjustment, battery operated electronic units and the like. Other devices may be added to more sophisticated models such as elapsed time indicators, compression rate, or compression efficiency indicators, or pause indicators, or alarms.

As will be apparent to persons skilled in the art, various modifications, adaptations and variations of the foregoing specific disclosure can be made without departing from the teachings of the present invention.

I claim:

1. A disposable external cardiac compression device particularly well suited for accurate placement and retention on a patient longitudinally along the patient's lower sternum during CPR use comprising an elongated main body portion of relatively noncompressive unyielding material and top and bottom layers of relatively softer cushion-like material on opposite sides of the main body portion along the longitudinal extent thereof, said bottom layer extending longitudinally beyond said main body member to form projecting locator flange portions, said top layer having an outer top surface of a length and width sufficient to conformably accommodate engagement by the heel of a hand placed thereon, said top surface being spaced from the outer bottom surface of said bottom layer by the distance of at least the minimum CPR recommended compression depth, said projecting locator flange portions having a length substantially equal to the width of two fingers and being of sufficient flexibility to permit ready yielding upon application of pressure against said top surface, said bottom surface having adhesive means thereon for removably adhering the device to a patient during CPR use.

2. The disposable cardiac compression device of claim 1 wherein the top and bottom layers are sufficiently resilient to conform to body structure variations brought into contact therewith.

3. The disposable cardiac compression device of claim 1 wherein the main body portion is formed of a high compression strength foam plastic material and said layers are formed of resilient foam plastic material fixedly secured to said body portion.

4. The external cardiac compression device of claim 1 wherein the adhesive means extends along the full length of the device and includes an adhesive layer on said bottom surface and a releasable protective strip covering said adhesive layer.

5. The external cardiac compression device of claim 1 wherein the main body portion houses palpable signaling means responsive to pressure applied to said top surface.

6. The external cardiac compression device of claim 1 wherein the main body portion is provided with a transverse cavity spaced from said top and bottom surfaces and a pressure responsive signaling device is mounted within said cavity for providing a palpable signal in response to the application of a preselected pressure to said top surface.

7. The external cardiac compression device of claim 5 wherein said transverse cavity extends through said main body portion and said pressure responsive signaling device is removably mounted therein.

* * * * *